US005581948A

United States Patent [19]

Simonsen

[11] Patent Number: 5,581,948

[45] Date of Patent: Dec. 10, 1996

[54] KICK RESISTANT DOOR ASSEMBLY

[76] Inventor: Eric A. Simonsen, 2034 Milford, Houston, Tex. 77098

[21] Appl. No.: 514,452

[22] Filed: Aug. 11, 1995

[51] Int. Cl.[6] ..... E06B 1/04

[52] U.S. Cl. ..... 49/460; 16/388; 49/501; 49/504; 52/514; 292/346

[58] Field of Search ..... 49/460, 504, 501; 70/417, 418; 292/346; 52/514; 16/382, 388, 387

[56] References Cited

U.S. PATENT DOCUMENTS

| | | | |
|---|---|---|---|
| 3,888,530 | 6/1975 | Fabrici | 292/346 X |
| 3,918,207 | 11/1975 | Aliotta . | |
| 4,074,484 | 2/1978 | Queren . | |
| 4,174,862 | 11/1979 | Shane . | |
| 4,416,087 | 11/1983 | Ghatak . | |
| 4,474,394 | 10/1984 | Crepinsek . | |
| 4,635,399 | 1/1987 | Gehrke et al. . | |
| 4,690,445 | 9/1987 | Hartley . | |
| 4,704,767 | 11/1987 | Carter et al. | 16/388 |
| 4,717,185 | 1/1988 | Hartley . | |
| 4,771,506 | 9/1988 | Allen | 16/388 X |
| 4,802,701 | 2/1989 | Mazie . | |
| 4,854,621 | 8/1989 | Baldwin . | |
| 4,858,384 | 8/1989 | Blankenship . | |
| 5,024,475 | 6/1991 | Francis | 292/346 X |
| 5,070,650 | 12/1991 | Anderson . | |
| 5,154,461 | 10/1992 | Prescott et al. . | |
| 5,241,790 | 9/1993 | Schimpf . | |
| 5,474,347 | 12/1995 | Vigneault et al. | 49/460 X |

*Primary Examiner*—Philip C. Kannan
*Attorney, Agent, or Firm*—Vaden, Eickenroht & Thompson, L.L.P.

[57] ABSTRACT

The kick resistant door assembly comprises a doorway framed by at least two door jamb segments, a door mounted by hinges to one of the segments and a specialized plate assembly which mounts to both a door jamb segment and to adjacent framing studs. The plate assembly has an opening for receiving a bolt and an extended portion for reinforcing the latch of the door against forcible entry. The assembly may further comprise reinforcing rods attached either directly to the hinges or to an intermediate reinforcing hinge plate. In either configuration, upon installation the reinforcing rods extend into the door as well as through the door jamb segment into the wall studs. The assembly may yet further comprise the use of additional plate assemblies mounted adjacent the hinges of the door with the openings of these additional plate assemblies aligned for receiving the reinforcing rods of the hinges.

16 Claims, 4 Drawing Sheets

KICK RESISTANT DOOR ASSEMBLY

BACKGROUND OF THE INVENTION

Security in the home is becoming an increasingly expensive commodity. The days when a burning porch light deterred criminal elements are only a memory. One of the most frightening trends to develop recently is the crash or kick burglary. This is the crime where the burglar intentionally waits until the resident is home then kicks in the front door and terrorizes and robs the resident. The present invention will provide the home owner with an inexpensive means of reinforcing a door to prevent a kick burglar from gaining access to the home.

Typically, external doors are mounted to the door jamb by at least a pair of hinges and are provided with a dead bolt lock which is extended into a recess provided in the jamb to secure the door in a closed position. The weakest region of a door frame is the region where the bolt interacts with the door jamb. The portion of the jamb that is provided for restraining the door bolt or latch generally measures only in fractions of inches and is commonly composed of wood. As can be seen on most any evening news broadcast, this material is easily splintered and broken through with only a moderate amount of force directed against the door adjacent the locking mechanism.

In addition, the hinges offer another source of weakness. Generally hinges are attached to a door jamb and to the door using only short screws having small diameters. When the hinge region of a door is subjected to the kicking force of an intruder, a failure will generally occur as these screws will pull free of the door jamb and/or door.

A number of means have been developed to secure the home from the threat of kick burglars. These inventions have ranged from the installation of burglar bars, the use of wedges and braces, and through the installation of improvements to the door framing itself.

Improvements to the door frame or door jamb have with few exceptions been directed at improvements to the jamb in the region adjacent the locking mechanism of the door. Early improvements were directed to enlarging a striker plate for installation on the outer surface of the door jamb. While these developments allowed for an applied force to be distributed over a greater area, the resistance to the force still depends on the strength of a relatively weak section of the door jamb.

The next developments generally came in the form of reinforcing plates that were designed to be mounted to the jamb. U.S. Pat. No. 3,918,207 issued Nov. 11, 1975 to Aliotta discloses an L-shaped reinforcing plate that is mounted to the back of a jamb and has a flange for supporting the jamb in the region of the locking mechanism. Similarly, U.S. Pat. No. 4,074,484 issued Feb. 21, 1978 to Queren discloses a reinforcing plate that mounts to the wall studs and has flanged portion that extends outwardly for supporting the region of the door jamb receiving the bolt. And U.S. Pat. No. 4,174,862 issued Nov. 20, 1979 to Shane discloses a complicated U-shaped reinforcing plate that is installed around the wall studs and has a flange for supporting the jamb in the region receiving the bolt. Additional reinforcing efforts have resulted in complicated designs that require substantial machining to manufacture and/or intensive efforts to install.

Therefore, it is an object of this invention to provide a means for securing an external door against forcible entry, and more specifically, to prevent the unlawful entry of a kick burglar into a house or other building.

A further object of this invention is to provide such a secured doorway through the installation of a door assembly which can be inexpensively installed in both new and existing doorways with relative ease.

It is a further object of this invention to provide such an assembly that is of simple design and may be easily and inexpensively manufactured.

It is a further object of this invention to provide such an assembly that does not clutter or otherwise detract from the appearance of the home such that the benefits of this invention are not obtained at the expense of the home's aesthetics.

It is a further object of this invention to provide an assembly which is capable of reinforcing the doorway at any point where the door interacts with the door jamb.

It is a further object and feature of this application to provide a kick resistant door assembly that includes a doorway framed by at least two door jamb segments, a door mounted by hinges to one of the segments and a specialized plate assembly that mounts to both a door jamb segment and to adjacent framing studs for securing the door to the jamb segment. The plate assembly may be manufactured from a single rectangular plate and has a portion which is parallel to and attached to the jamb segment and a second portion which is attached to the framing studs. The portion of the plate assembly which is attached to the jamb segment has an opening for receiving a dead bolt extending from the door. Further, the plate assembly has an extended lip for reinforcing the region of the jamb where the latch of the door is received by the jamb. The door assembly may further comprise an external metal plate attached to the framing studs opposite the installation of the plate assembly such that the plate and plate assembly may be secured to one another. The door assembly may further comprise pairs of reinforcing rods attached to the hinges which extend into the door as well as through the jamb segment into the wall studs. The assembly may further comprise the use of additional plate assemblies mounted adjacent the hinges of the door with the openings of these additional plate assemblies aligned for receiving the reinforcing rods of the hinges.

It is a further object of the present invention that the plate assembly be configured for installation either in a region receiving the door's locking mechanism or in the region where the hinges are attached.

These and other objects, advantages, and features of this invention will be apparent to those skilled in the art from a consideration of the attached drawings and appended claims.

DETAILED DESCRIPTION OF THE PREFERRED EMBODIMENT

Figure 1:
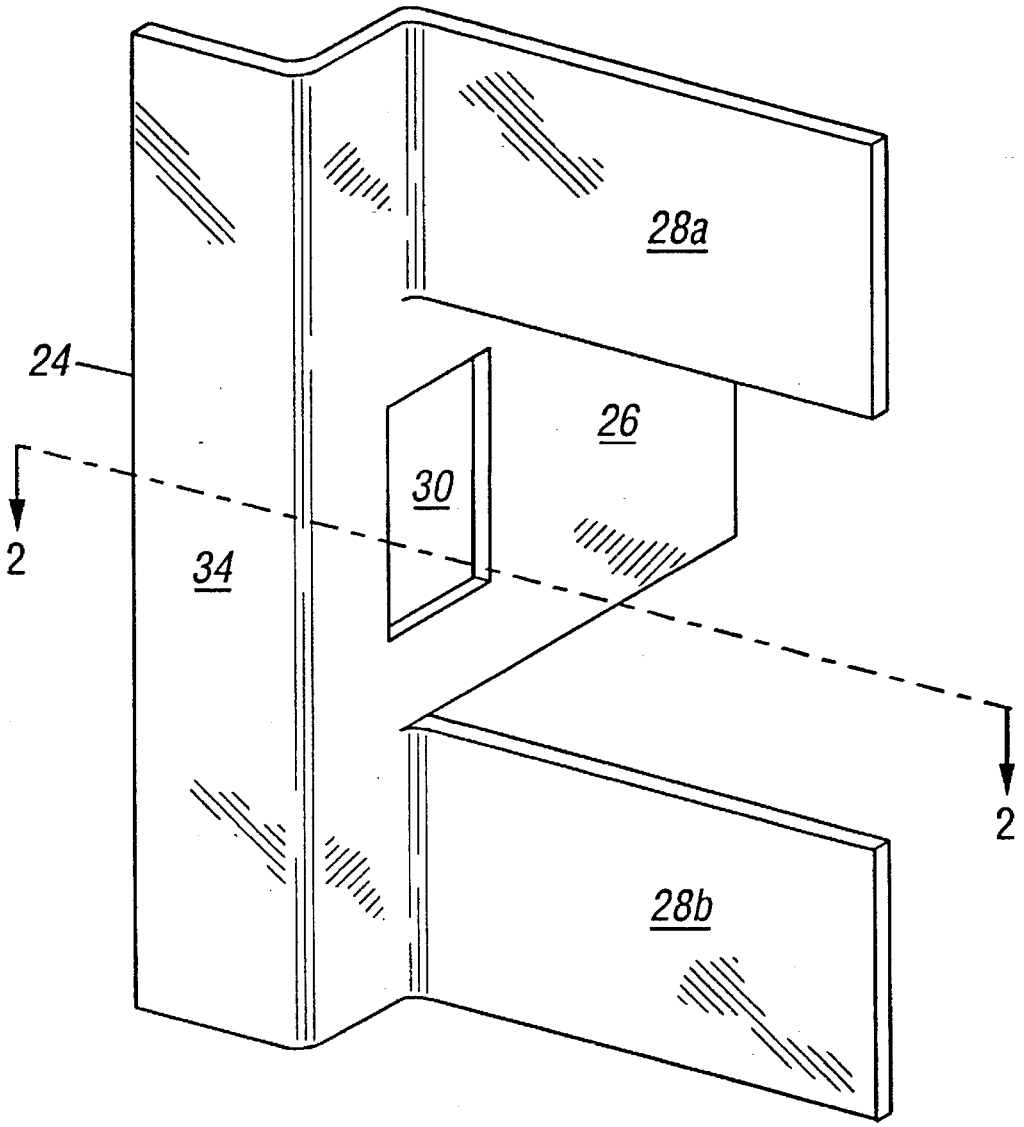
FIG. 1 is an isometric view of the plate assembly of the present invention which may be installed either adjacent the hinge mounts or adjacent the region where the door jamb receives the locking mechanism.

Plate assembly 24 in FIG. 1 is made of high yield strength material such as steel. The assembly includes first tab 26 and second tabs 28*a* and 28*b* that extend outwardly from first tab 26 at 90°. Plate assembly 24 also includes lip 34 parallel but opposite to tabs 28*a* and 28*b*.

Figure 2:
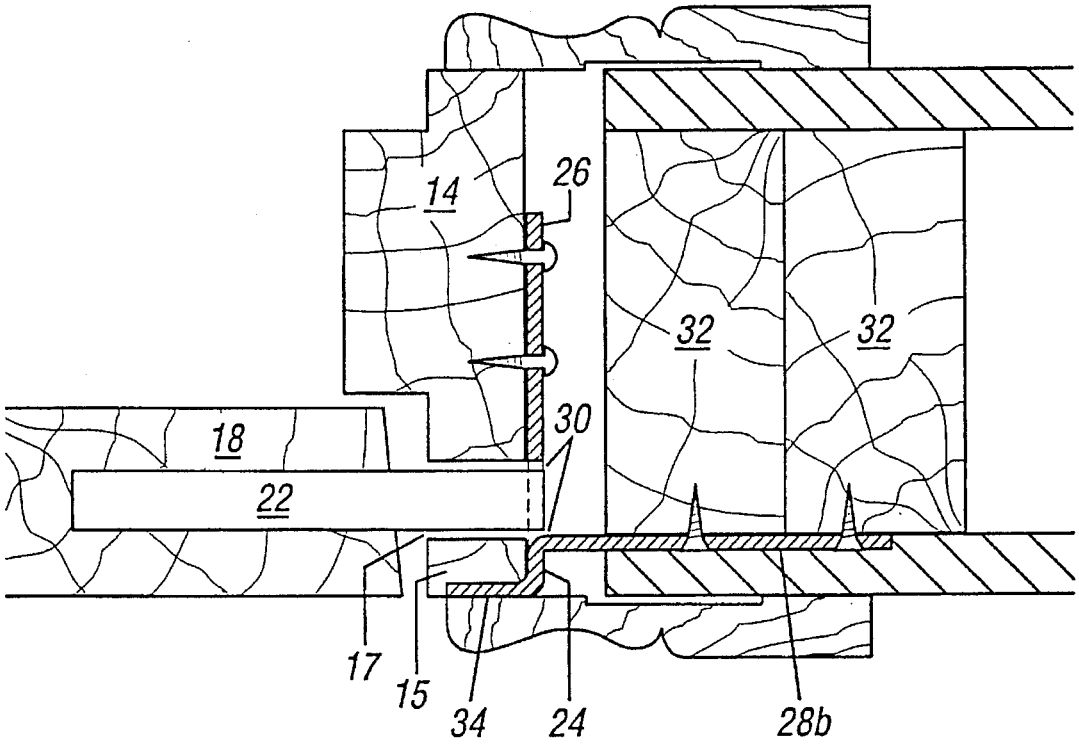
FIG. 2 is a cross-sectional view of a side lock and door jamb segment with the plate assembly of FIG. 1 installed.

As indicated in FIG. 2, first tab 26 and second tabs 28*a*, 28*b* are provided with holes for mounting the plate assembly to first jamb segment 14 and to the wall studs 32, respectively. Plate assembly 24 is mounted to these respective structures by means of screws although it may be attached by any means that will securely fasten it to the wall studs 32 and jamb segment 14.

As stated above, one of the objects of this invention is to provide an assembly that is easily installed in both new and existing door frames. As shown in FIG. 2, when plate assembly 24 is installed in an existing doorway, the only modification that is required is to remove enough wood from the inside surface of first jamb segment 14 so that lip 34 of the plate assembly will be flush with that inside surface. In this disclosure, an "inside surface" will refer to a surface that fronts the interior of the home or building while an "outside surface" will refer to a surface that fronts the exterior of the home or building.

First tab 26 is provided with an opening 30 for receiving a dead bolt 22 extending from the door. In addition, lip 34 of second tab 28 extends along the inside surface of the door jamb to support jamb region 15 adjacent to jamb recess 17. When the bolt is in an extended position and a force is applied to the door, the force is transferred from the door directly to both the inside surface of the opening 30 and lip 34. The force is then distributed through plate assembly 24 to the first jamb segment 14 and the inside surface of wall studs 32. This transfer of force prevents jamb region 15 from splintering and breaking away and allowing the intruder access to the home. When no bolt is extended and only a latch (not shown) secures the door to the door jamb, an applied force is transferred to lip 34 to prevent the splintering and breaking away of jamb region 15.

Figure 6:
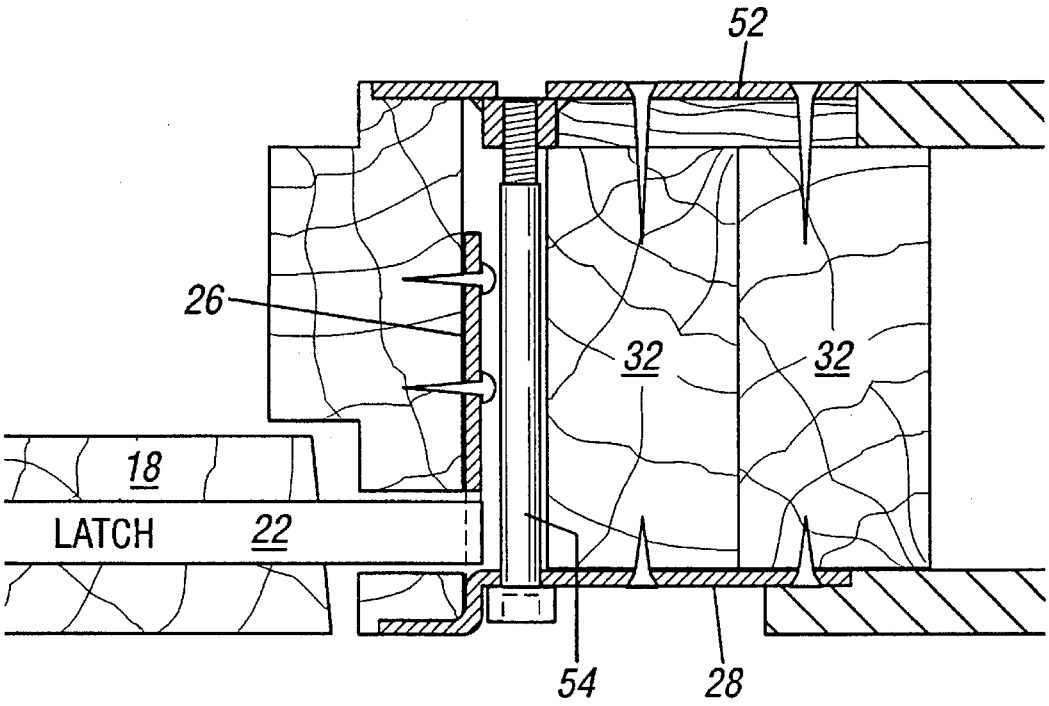
FIG. 6 is a cross-sectional view of a side lock and door jamb segment with the plate assembly of FIG. 1 installed and also showing an installed external metal plate.

Plate assembly 24 may be further secured against the force of an intruder by using an external plate 52 as shown in FIG. 6. External plate 52 is first attached to the outside surface of the walls studs opposite the installation of plate assembly 24. Plate assembly 24 is then secured to outside plate 52, such as by means of an elongated bolt and nut. In this configuration, the kicking force described above will be distributed to both sides of the wall studs providing a sound anchoring for plate assembly 24.

In conjunction with plate assembly 24, a door may be further secured against a kicking force by reinforcing the regions of the door frame where the hinges are attached. This is achieved by installing a set of reinforcing rods 38 as depicted in FIGS. 4*a*–4*c* and 5*a*–5*c*. Reinforcing rods 38 are preferably ¼" steel dowel rods which are attached in pairs to each hinge leaf 21. Further, reinforcing rods 38 should be of sufficient length such that when the hinge is installed, one pair of rods will extend into the interior of the door and the other will pass through the jamb segment into the adjacent wall stud.

Figure 4A:
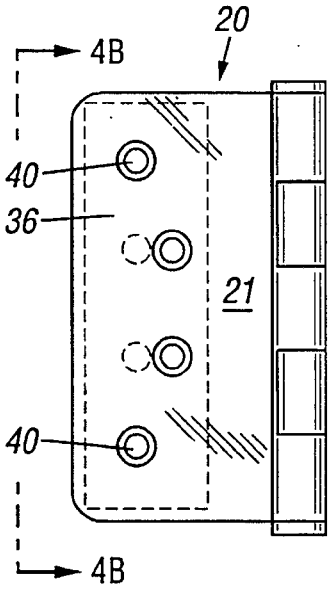
FIG. 4*a* is side view of a reinforced hinge assembly for use with this invention to provide additional resistance to kick burglars.
Figure 4B:
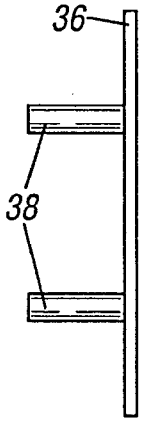
FIG. 4*b* is a profile of the reinforcing hinge plate showing the reinforcing rods discussed above.
Figure 4C:
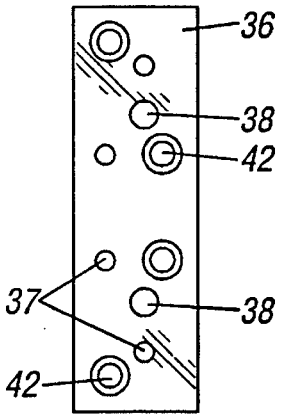
FIG. 4*c* is a reverse view of the reinforcing hinge plate showing the surface of the reinforcing hinge plate.

As depicted in FIG. 4*a*, a hinge 20 has been modified by attaching a reinforcing hinge plate 36 (shown in outline) to a hinge leaf 21. As shown in FIG. 4*c*, reinforcing hinge plate 36 is provided with holes 37 for being secured to hinge leaf 21 by machine screws. Further, holes 37 are provided in a number of configurations in order to align with the different configurations of holes provided in various standard hinge leaves 21. Further still, holes 37 are drilled and tapped to receive machine screws 40 securing hinge leaf 21 to reinforcing plate 36. Lastly, reinforcing hinge plate 36 is provided with reinforcing rods 38 which may be attached by plug weld or mounting screws. To install the configuration depicted in FIG. 4*a*, reinforcing hinge plate 36 is first secured to either a door or jamb segment through holes 42 and then hinge leaf 21 is aligned with holes 37 and secured by machine screws.

Figure 5A:
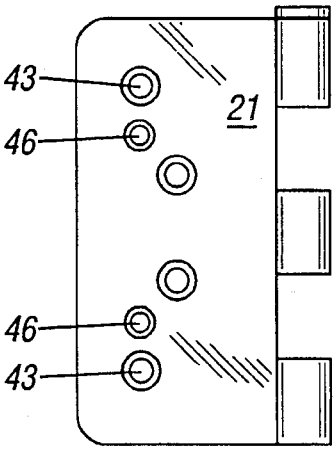
FIG. 5*a* is side view of a hinge leaf of this invention showing the embodiment where the reinforcing rods are directly attached to the hinge leaf.
Figure 5B:
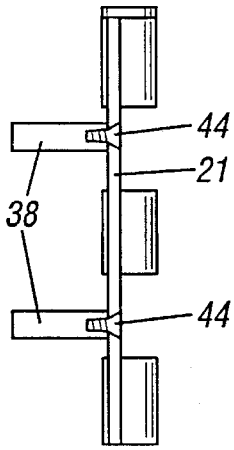
FIG. 5*b* is a profile of the hinge leaf of FIG. 5*a* showing the reinforcing rods attached to the hinge leaf by machine screws.
Figure 5C:
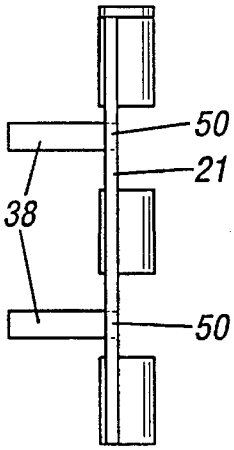
FIG. 5*c* is a profile of the hinge leaf of FIG. 5*a* showing the reinforcing rods attached to the hinge leaf by plug weld.

Alternatively, as depicted in FIGS. 5*a*–5*c*, hinge leaf 21 may be modified with the reinforcing rods 38 without the added structure of a reinforcing hinge plate. As shown in FIG. 5*a*, hinge leaf 21 is provided with a pair of holes 46 through which reinforcing rods 38 may be attached. In FIG. 5*b*, reinforcing rods 38 are attached to hinge leaf 21 with machine screws 44. In FIG. 5*c*, reinforcing rods 38 are attached to hinge leaf 21 by plug weld.

Once reinforcing rods 38 have been securely attached, the separate hinge leaves 21 are individually mounted to the door and the door jamb segments. Again, this installation is simplified in that the only modification needed is the drilling of pairs of holes for receiving reinforcing rods 38. Reinforcing rods 38 are then inserted into the holes and hinge leaves 21 are secured to the jamb segment and to the door. The door is then positioned so that the individual hinge leaves interlock and the hinge pin inserted. In this configuration, reinforcing rods 38 are substantially perpendicular to a force being applied to the door and serve to prevent the hinge screws from pulling free under that force.

Figure 3:
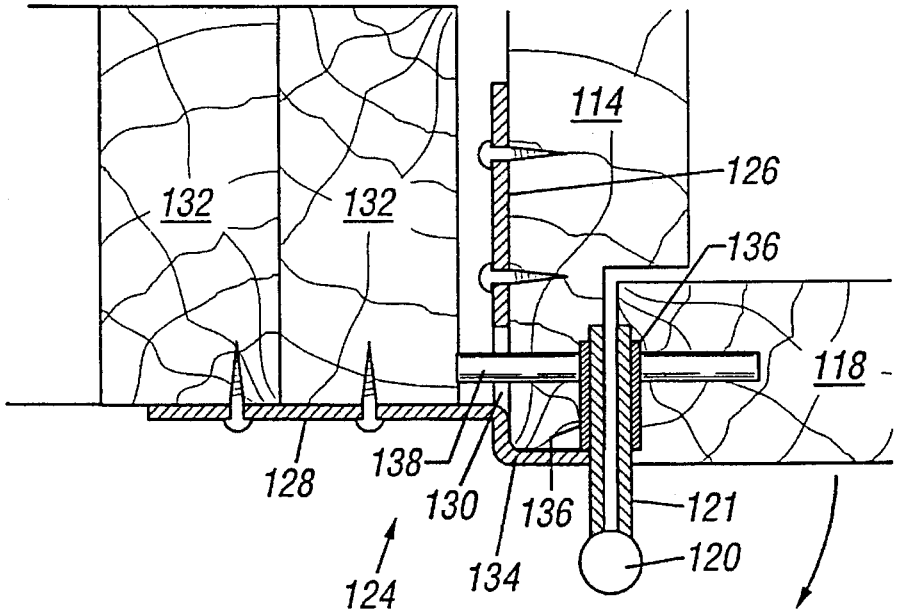
FIG. 3 is a cross-sectional view of a hinge and door jamb segment equipped with the plate assembly of FIG. 1.

The benefits of using the hinges modified with reinforcing rods as discussed above may be greatly enhanced when additional plate assemblies are installed adjacent the hinge installations. As depicted in FIG. 3, an additional plate assembly 124 is installed such that first tab 126 is attached to second jamb segment 114, second tab 128 is attached to wall studs 132, and opening 130 is aligned for receiving reinforcing rods 138. Further, reinforcing hinge plate 136 is in direct contact with, abutting lip 134 of plate assembly 124. When a force is applied to a door having the assembly shown in FIG. 3, the force is transferred through both the reinforcing rods 138 and reinforcing hinge plate 136 to the jamb segment 114, the wall studs 132 and extension 134. This distribution of force will prevent the hinge attachment from failing and breaking away from the door frame.

The plate assembly that is disclosed has been designed such that it may be installed either as a means of reinforcing the jamb in a region of a locking mechanism or in a region where hinges attach. Thus, it is also anticipated that plate assembly 24 could be installed between a horizontal top jamb segment and header studs so as to receive a vertical flush bolt from a door. This flexibility of use helps to minimize the number of different components that are required for a kick resistant door assembly. Further, the designs of both the plate assembly and the modified hinges are intended to facilitate their installation in either new or existing doorways.

From the foregoing it will be seen that this invention is one well adapted to attain all of the ends and objects herein above set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A kick resistant door assembly comprising:

a door frame having an opening therethrough and first and second jamb segments framing the opening;

a door, a pair of hinges, each hinge including jointed metal leaves, one of which being attached to the door and the other being attached to the second jamb segment to support the door for pivotable movement between an open and closed position, the door having a locking member for securing the door to the first jamb segment when the door is in its closed position; and a plate assembly having a first tab attached to the first jamb segment on the side opposite the door, and a second tab integral with the first tab attached to the inside surface of the wall studs adjacent the first jamb segment, the first tab having an opening therein for receiving the locking member of the door, and the second tab having a portion that extends over the inside end surface of the first jamb segment to resist any forces imposed on the door from the outside adjacent the first jamb segment.

2. The assembly of claim 1, wherein the plate assembly is made of steel.

3. The assembly of claim 1, further comprising an external metal plate attached to the outside surface of the wall studs and a means for securing the second tab of the plate assembly to this external metal plate.

4. The assembly of claim 3, wherein the means for securing the second tab of the plate assembly to the external metal plate is an elongated bolt extending through the second tab and fastened to the external metal plate.

5. The assembly of claim 1, further comprising a reinforcing plate attached to each hinge leaf, the reinforcing plate having a pair of metal rods extending into the door when the hinge plate is attached to the door and extending into the wall studs when the other hinge plate is attached to the second jamb segment.

6. The assembly of claim 1, wherein the hinges further include a pair of metal rods attached to each hinge leaf, the metal rods extending into the door when the hinge leaf is attached to the door and extending into the wall studs when the hinge leaf is attached to the second jamb segment.

7. A kick resistant door assembly comprising:

a door frame having an opening therethrough and first and second jamb segments framing the opening;

a door, a pair of hinges, each hinge including jointed metal leaves, one of which being attached to the door and the other being attached to the second jamb segment to support the door for pivotable movement between an open and closed position, the door having a locking member for securing the door to the first jamb segment when the door is in its closed position;

a first plate assembly having a first tab attached to the first jamb segment on the side opposite the door, and a second tab integral with the first tab attached to the inside surface of the wall studs adjacent the first jamb segment, the first tab having an opening therein for receiving the locking member of the door, and the second tab having a portion that extends over the inside end surface of the first jamb segment to resist any forces imposed on the door from the outside adjacent the first jamb segment; and a second plate assembly having a first tab attached to the second jamb segment on the side opposite the door, and a second tab integral with the first tab attached to the inside surface of the wall studs adjacent the second jamb segment, the second tab having a portion that extends over the inside end surface of the second jamb segment to resist any forces imposed on the door from the outside adjacent the second jamb segment.

8. The assembly of claim 7, wherein the plate is made of steel.

9. The assembly of claim 7, further comprising an external metal plate attached to the outside surface of the wall studs and a means for securing the second tab of the first plate assembly to this external metal plate.

10. The assembly of claim 9, wherein the means for securing the second tab of the first plate assembly to the external metal plate is an elongated bolt extending through the second tab and fastened to the external metal plate.

11. The assembly of claim 7, further comprising a reinforcing plate attached to each hinge leaf, the reinforcing plate having a pair of metal rods extending into the door when the hinge leaf is attached to the door and extending into the wall studs when the other hinge leaf is attached to the second jamb segment.

12. The assembly of claim 11, wherein the first tab of the second plate assembly is having an opening therein for receiving the metal rods of the reinforcing plate.

13. The kick resistant door assembly of claim 12 wherein the first and second plate assemblies have the same configuration and dimensions.

14. The assembly of claim 7, wherein the hinges further comprise a pair of metal rods attached to each hinge leaf, the metal rods extending into the door when the hinge leaf is attached to the door and extending into the wall studs when the other hinge leaf is attached to the second jamb segment.

15. The assembly of claim 14, wherein the first tab of the second plate assembly is having an opening therein for receiving the metal rods of the hinge leaf.

16. The kick resistant door assembly of claim 15 wherein the first and second plate assemblies have the same configuration and dimensions.

* * * * *